United States Patent [19]

Miller et al.

[11] 4,109,699

[45] Aug. 29, 1978

[54] PATTERN ASSEMBLY

[75] Inventors: Robert R. Miller, Shaker Heights; Robert A. Horton, Chesterland, both of Ohio

[73] Assignee: Precision Metalsmiths, Inc., Cleveland, Ohio

[21] Appl. No.: 664,241

[22] Filed: Mar. 5, 1976

Related U.S. Application Data

[63] Continuation of Ser. No. 511,458, Oct. 2, 1974, abandoned.

[51] Int. Cl.[2] ..... B22C 7/02

[52] U.S. Cl. ..... 164/244; 164/35

[58] Field of Search ..... 164/35–37, 164/129, 244, 361; 249/62

[56] References Cited

U.S. PATENT DOCUMENTS

| | | | |
|---|---|---|---|
| 2,666,239 | 1/1954 | Farrell | 164/244 |
| 2,875,485 | 3/1959 | Schneider | 164/35 X |
| 3,041,688 | 7/1962 | Wilder | 164/35 X |
| 3,041,689 | 7/1962 | Peras | 164/35 |
| 3,283,376 | 11/1966 | Hockin | 164/129 |
| 3,669,177 | 6/1972 | Ingalls | 164/129 X |

*Primary Examiner*—Francis S. Husar
*Assistant Examiner*—John S. Brown
*Attorney, Agent, or Firm*—Watts, Hoffmann, Fisher & Heinke

[57] ABSTRACT

A pattern assembly for use in the lost pattern process of investment casting characterized by a center tree or sprue member including a central stem and a plurality of laterally projecting collars spaced apart along the stem and united therewith to provide the surface area for gating the patterns, the cross-sectional size of the stem being greater than the projecting width of the collar, whereby the stem serves to form a riser.

7 Claims, 7 Drawing Figures

PATTERN ASSEMBLY

CROSS REFERENCE TO RELATED APPLICATION

This application is a continuation of U.S. application, Ser. No. 511,458 filed Oct. 2, 1974 by Robert R. Miller and Robert A. Horton, entitled PATTERN ASSEMBLY and now abandoned.

BACKGROUND OF THE INVENTION

This invention relates generally to the lost pattern process of investment casting, and more specifically to the formation of the pattern assemblies used in such a process.

In the lost pattern process, a pattern assembly is conventionally prepared by attaching a plurality of patterns around a cylindrical sprue or center tree to form a branched "set-up." A pouring cup or well is frequently attached to the cylindrical center tree. The patterns, which are replicas of the parts to be cast in metal and include the necessary gates and risers, are made of an expendable material, such as wax, synthetic resin or a wax and synthetic resin composition. The pattern set-up is coated or invested with a suitable slurry which is allowed to harden to form a refractory mold. Thereafter, the patterns are destroyed, such as by subjecting the mold to heat or a solvent for the pattern material or both, to form the mold cavities.

In order to obtain the maximum yield of investment castings from a mold, it is desirable to attach as many patterns around the center tree or sprue as possible. The number of patterns of a given size that can be attached to a center tree having a given height depends upon the circumference of the center tree which is directly proportional to its diameter. The larger the diameter is of a center tree, the more patterns that can be clustered about it.

The size to which the diameter of a center tree can be increased to accommodate more castings is limited by the fact that the volume of metal required to fill the sprue passage in a mold increases as the square of the diameter of the center tree used to form the passage. In fact, it can be readily shown that the ratio (R) of the volume (V) of a mold sprue passage formed by a center tree to the area (A) of the center tree available for gating patterns increases directly with the tree diameter according to the relation $R = V/A = D/4$. This means that an increase in the center tree diameter can quickly lead to an excessive ratio of scrap sprue metal to usable castings which outweighs any advantage of being able to cluster more patterns around the center tree and makes the large diameter center tree impractical from an economic standpoint.

Another important consideration in making a pattern set-up is the spacing between the casting patterns around the center tree. The patterns must not be so close together as to prevent proper formation of the refractory investment mold or solidification of the metal in the mold cavities, etc. Because of a particular size or shape of the patterns, it has been possible in some situations to cluster only a few patterns around the center tree by conventional techniques. An increase in the tree diameter in order to accommodate more patterns while retaining the required spacing between them leads to an excessive R ratio for the reasons discussed above. An increase in the lengths of the pattern gates in an attempt to provide more room for patterns around the center tree is often unsatisfactory because the longer gates reduce the metal feeding ability of the sprue and can result in unsound castings.

SUMMARY OF THE INVENTION

The present invention is concerned with increasing the number of patterns that can be clustered around a center tree of a given height so that more investment castings can be economically made in a single mold. The invention is particularly concerned with a new center tree or sprue construction which provides a significant increase in the surface area available for gating patterns without requiring an excessive or impractical amount of metal to fill a sprue passage formed in an investment mold by use of the new center tree.

The new sprue construction of the invention includes a central stem and a plurality of circumferentially enlarged, laterally projecting collars spaced apart along the length of the stem to provide the surface area for gating patterns. The cross-sectional size of the stem is greater than the projecting lateral width of each collar, whereby the stem serves as a riser-forming member, and the juncture of each collar with the stem is structurally continuous about the stem and extends substantially the full axial thickness of the collar.

As a result of the larger diameter of the collars compared to that of the central stem, more patterns can be clustered around the new center tree than around a conventional cylindrical center tree having the diameter of the center stem. At the same time, the increase in the amount of metal required to fill a sprue passage formed by the new center tree is much less than in the case of a sprue passage formed by a conventional cylindrical sprue made to have the same diameter as the collars in order to accommodate the same number of patterns.

Although the invention is preferably describd in connection with the formation of center trees which are circular in cross-section, it also has useful applicability in the case of center trees having flat external surfaces, such as those which are square, triangular, rectangular, hexagonal, etc. in cross-section. Such center trees are often used with large patterns having large gates that are more easily attached to flat surfaces than round ones. When constructed in accordance with the present invention, center trees of non-circular cross-section are made with longitudinally spaced, peripherally enlarged portions in the areas where the patterns are attached and with portions of smaller cross-sectional size between the horizontal rows of patterns. Although in some cases it may not be possible to attach more patterns to the new center tree than to a conventional one, the invention nevertheless achieves a smaller R ratio by reducing the volume of the sprue passage which is formed in the mold.

It will also be seen that the invention makes it possible to increase the number of patterns clustered around a center tree in a set-up and/or decrease the volume of the sprue passage formed by the center tree while maintaining a required peripheral spacing between the patterns.

Still other advantages and a fuller understanding of the invention will be had from the following detailed description when taken in conjunction with the accompanying drawings.

DESCRIPTION OF THE PREFERRED EMBODIMENTS

Figure 1:
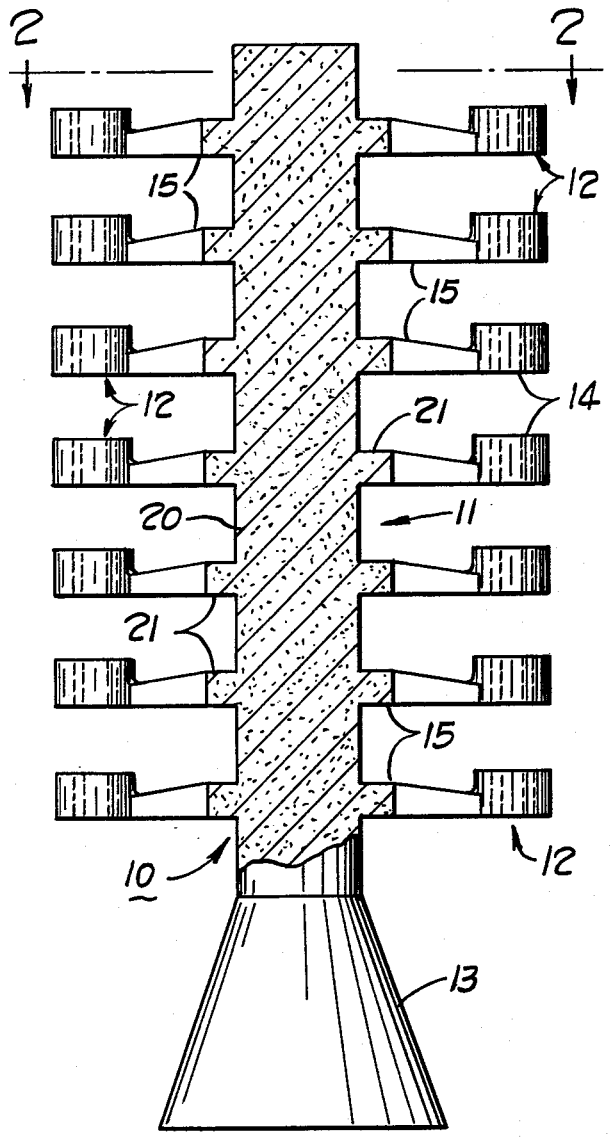
FIG. 1 is an elevational view, partially in cross-section, of a pattern set-up embodying the new center tree construction of this invention.
Figure 2:
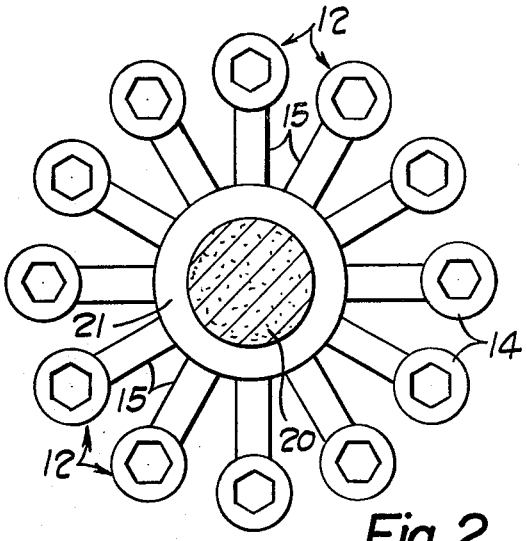
FIG. 2 is a cross-sectional view taken along the line 2—2 of FIG. 1.

Referring now to the drawings, and to FIGS. 1 and 2 in particular, a pattern set-up is generally designated by reference numeral 10. The set-up 10 is comprised of a center tree or sprue 11 and a plurality of workpiece or casting patterns 12 mounted around the outside of the center tree 11 in longitudinally spaced rows. A pouring cup or well member 13 is shown attached to one end of the center tree 11, although it is to be understood that the use of such a member is optional. Where the diameter of the center tree is small, a pouring cup may be needed to provide a sufficiently large opening to facilitate introduction of the molten metal into the mold. Depending upon the size of the center tree and the patterns, a pouring cup may also be required to serve as a riser. In other cases, as when the tree diameter is large and the patterns are small, a pouring cup or extra riser normally is not required.

The workpiece patterns 12 may be formed of any suitable expendable materal used in the investment casting industry, such as wax, a synthetic resin or a wax and synthetic resin composition. As shown, each of the patterns 12 includes a main portion 14 which defines the shape of a part to be cast in metal and a gate 15 which has its root end attached to the outside of the center tree 11.

According to the invention, the center tree or sprue member 11 is peripherally enlarged in longitudinally spaced zones where the patterns are attached, while the portions of the tree between the peripherally enlarged zones are of smaller diameter. As shown in FIG. 1, the center tree 11 is formed to include a cylindrical stem 20 and a plurality of circumferentially enlarged collars 21 which are spaced apart along the length of the stem 20. The diameter of each of the collars 21 is larger than that of the central stem 20.

It will be seen in FIG. 2 that the cross-sectional size, i.e., the diameter, of the stem 20 is greater than the radially projecting widths of the collars 21. This construction is such that the large stem 20 will form a riser in the mold for the smaller areas formed by the collars 21. It will also be seen in FIGS. 1 and 2 that the junctures of the collars 21 with the stem 20 are structurally continuous about the stem and extend the full axial thickness of each collar. This construction creates the proper sprue formation in the mold which allows for full metal flow from the riser portion into the surrounding collar areas.

The enlarged collars 21 provide the surface area for gating the patterns 12. The distance between the collars depends upon the dimensions of the particular patterns in the vertical or longitudinal direction, as well as the longitudinal spacing which is desired or required between the patterns so that a satisfactory refractory mold can be formed around the set-up. The thicknesses of the collars 21 can vary depending upon the thickness of the ends of the pattern gates 15. In some cases, the collars 21 can be made thicker than the ends of the pattern gates in order to facilitate feeding of the pattern cavities in a mold for longer radial distances from the sprue passage.

As generally explained above, the gates 15 of the patterns 12 are attached around the collars 21 in the normal manner. The large diameters of the collars compared to the relatively smaller diameter of the stem 20 permits more patterns to be mounted on the center tree 11 than on a conventional cylindrical center tree having the same diameter as the stem 20. The enlarged diameter collars 21 also make it possible to maintain the necessary horizontal spacing between the patterns in the several longitudinally spaced rows. In a mold made by use of the set-up 10, the amount of metal required to fill the sprue passage is less than required for a sprue passage formed by a center tree made to have the same diameter as the collars 21 in order to accommodate the same number of patterns.

In the embodiment of FIGS. 1 and 2, the stem 20 and the collars 21 are formed as a one-piece member. This can be accomplished in any suitable manner, as by injection molding the center tree 11 from wax or other expendable material.

Figure 3:
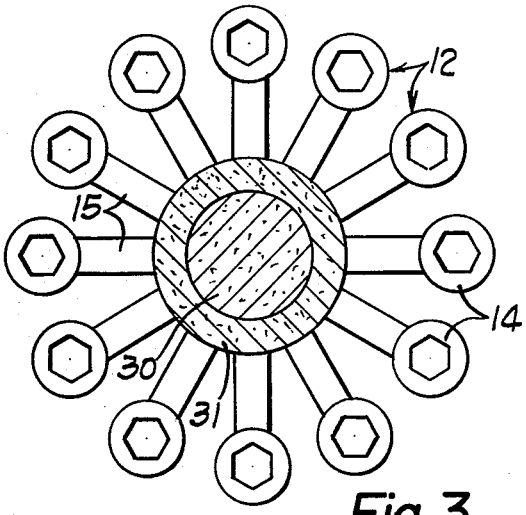
FIG. 3 is a cross-sectional view similar to FIG. 2 of another embodiment of the invention.

FIG. 3 illustrates a second embodiment of the invention similar to the one of FIGS. 1 and 2 except that the collars 31 are formed separately and attached to a stem 30. This design has the advantage of providing for flexibility in laying out a set-up, since the collars can be easily made in a variety of thicknesses and outer diameters and then spaced along the stem 30 at the desired locations which best suit particular gating requirements and individual pattern shapes and sizes.

Figure 4:
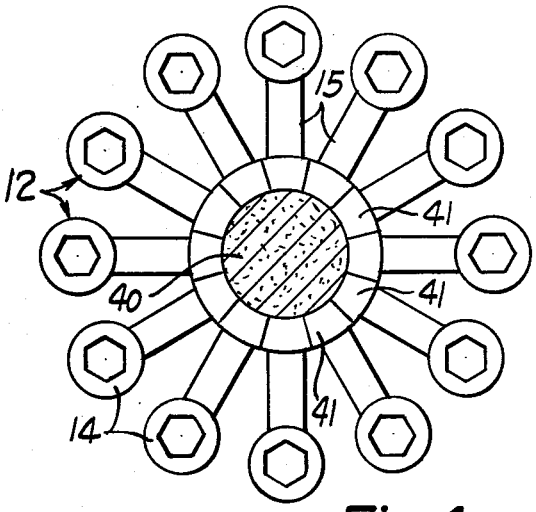
FIG. 4 is a cross-sectional view similar to FIG. 2 of still another embodiment of the invention.

In the embodiment of the invention illustrated in FIG. 4, the collars are formed in segments 41 and each segment is molded integrally with the gate end of a pattern 12. Several segments 41 are then fitted around a stem 40 to form complete collars, the segments being secured to each other and to the stem in any suitable manner, as by wax welding. As in the case of the embodiment of FIG. 3, the illustrated construction provides desired flexibility in laying out and assembling a set-up.

Figure 5:
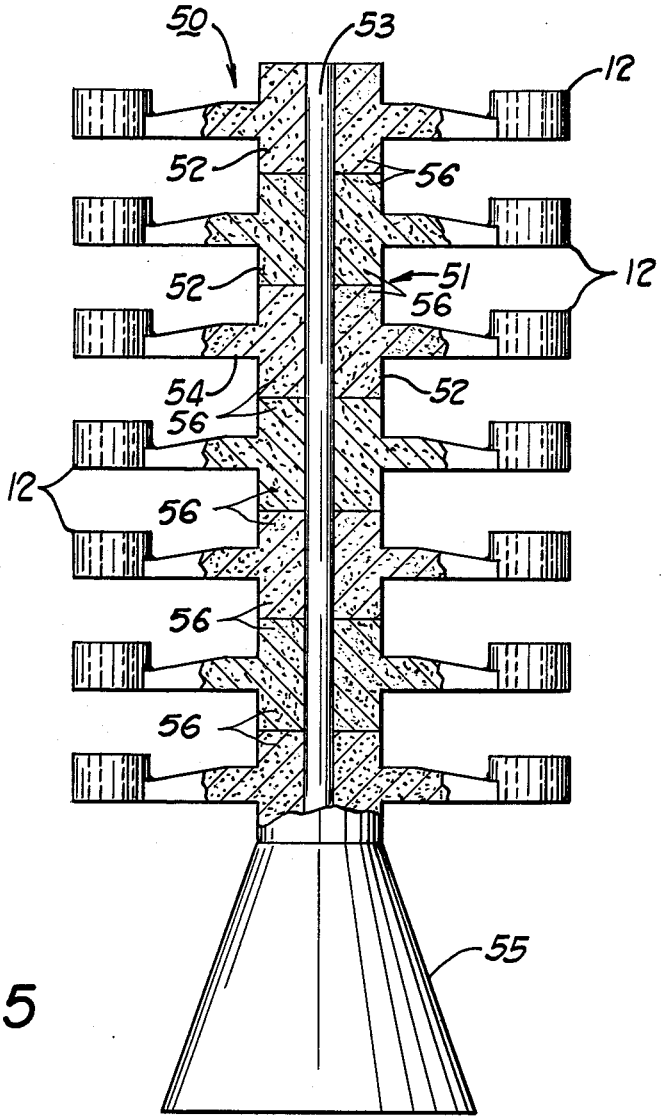
FIG. 5 is an elevational view, partially in cross-section, of a pattern assembly which embodies still another embodiment of the invention.
Figure 6:
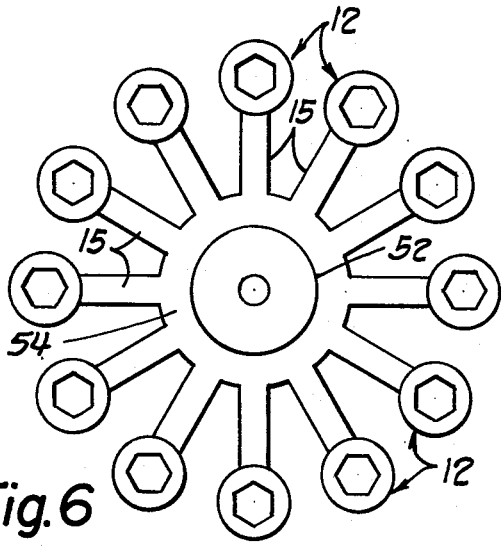
FIG. 6 is an end elevational view of a segment of the center tree construction shown in FIG. 5.

FIGS. 5 and 6 illustrate a set-up 50 which embodies the so-called "rosette" principle. The center tree 51 of the set-up 50 is formed in cylindrical segments 52 which are stacked end-to-end and secured together in any suitable manner, as by a center rod 53. Each cylindrical segment has an integral circumferential collar 54 and reduced diameter neck portions 56 extending from the sides of the collar. When the segments 52 are stacked end-to-end, the neck portions 56 cooperate to form a stem corresponding to the stems in the embodiments of FIGS. 1–4. In the assembled set-up, the circumferentially enlarged, laterally projecting collars 54 are spaced apart along the length of the stem. As in the case of each of the previously described embodiments, the cross-sectional size of the stem formed by the aligned neck portions 56 is larger than the radially projecting widths of the collars 54. As shown, the patterns 12 are molded integrally with the collars 54, but the patterns can be separately attached, if desired. As in the embodiment of FIG. 1, the set-up 53 may include a pouring cup former or well member 55.

Figure 7:
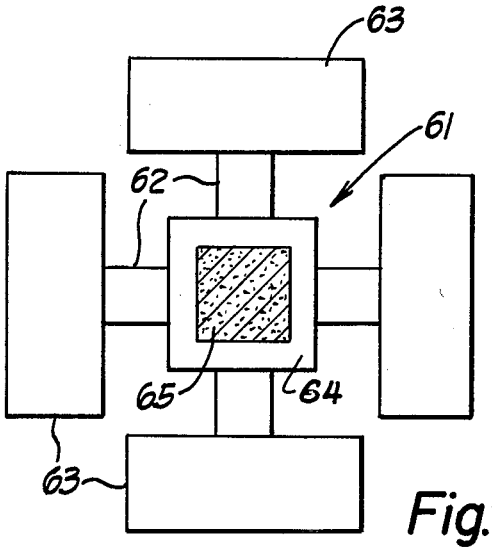
FIG. 7 is a horizontal cross-sectional view of still another embodiment of the invention.

FIG. 7 illustrates an embodiment of the invention in which the center tree 61 is of rectangular cross-sectional configuration in order to provide flat surfaces for attaching the gates 62 of large patterns 63. The center tree 61, which can be injection molded from wax or other expendable material, has longitudinally spaced collars 64 (only one of which is shown) to which the gates 62 are suitably connected, as by wax welding. The stem portion 65 of the center tree between the collars 64 is of reduced diameter and is of larger cross-sectional size than the projecting width of each collar 64. The collars 64 make it possible to provide the necessary horizontal spacing between patterns, while the stem areas of reduced size result in a sprue passage which requires less metal to fill than a passage formed by a conventional center tree accommodating the same number of patterns.

It will be seen that each embodiment of the invention makes it possible to achieve a lower ratio R of sprue metal to gating area. In each instance this is accomplished by increasing the gating area of a center tree so that more patterns can be clustered around it and/or by decreasing the volume of the sprue passage which is formed in the investment mold.

Many other modifications and variations of the invention will be apparent to those skilled in the art in the light of the foregoing detailed disclosure. Therefore, it is to be understood that, within the scope of the appended claims, the invention can be practiced otherwise than as specifically shown and described.

We claim:

1. A pattern set-up for use in the lost pattern process of investment casting comprising:

(a) a center tree including a stem and a plurality of collars which project from the sides of said stem and are spaced apart along its length, (b) the laterally projecting width of each collar from the side of said stem to the outside of the collar measured along a diameter of said stem being smaller than said diameter, (c) the juncture of each of said collars with said stem being structurally continuous about said stem and extending substantially the full axial thickness of the collar, (d) a plurality of patterns arranged about said collars, and (e) gate members extending from said patterns and having end portions connected to said collars.

2. A pattern set-up as claimed in claim 1 in which said collars extend completely about said stem.

3. A pattern set-up as claimed in claim 1 in which said stem and said collars are formed as a one-piece member.

4. A pattern set-up as claimed in claim 1 in which said collars are formed as separate members and are connected to said stem.

5. A pattern set-up as defined in claim 1 in which said collars are defined by perimetrical segments connected to and arranged about said stem in side-by-side relation.

6. A pattern set-up as claimed in claim 1 in which said center tree is formed in a plurality of segments which are arranged in end-to-end relation.

7. A pattern set-up as claimed in claim 1 in which said collars are of polygonal cross-sectional configuration.

* * * * *